US005624038A

United States Patent [19]

Curtis

[11] Patent Number: 5,624,038

[45] Date of Patent: Apr. 29, 1997

[54] CURVED FREE STANDING GARDEN SIEVE

[76] Inventor: Thomas M. Curtis, 1385 York Ave., New York, N.Y. 10021

[21] Appl. No.: 520,051

[22] Filed: Aug. 28, 1995

[51] Int. Cl.[6] ..... B07B 1/06

[52] U.S. Cl. ..... 209/281; 209/374; 209/375; 209/412; 209/417; 209/420

[58] Field of Search ..... 209/281, 274, 209/352, 412, 409, 417, 375, 420, 235, 255, 370, 374, 414

[56] References Cited

U.S. PATENT DOCUMENTS

| | | | |
|---|---|---|---|
| 155,245 | 9/1874 | Leach | 209/420 |
| 311,485 | 2/1885 | Gridley et al. | 209/412 |
| 1,424,451 | 8/1922 | Crandall . | |
| 1,510,742 | 10/1924 | Gutleben . | |
| 1,629,149 | 5/1927 | Citrin . | |
| 2,037,078 | 4/1936 | Levy | 209/352 |
| 3,307,698 | 3/1967 | Haffner | 209/420 X |
| 4,350,584 | 9/1982 | Donington | 209/420 X |
| 4,505,812 | 3/1985 | Lees | 209/405 X |

*Primary Examiner*—David H. Bollinger
*Attorney, Agent, or Firm*—Schweitzer Cornman & Gross

[57] ABSTRACT

A free standing curved garden sieve of parabolic shape to separate stones and coarse matter from garden soil as the garden soil travels from upper substantially vertical portions to lower substantially horizontal portions.

3 Claims, 1 Drawing Sheet

10
11
12
13
14
15
18
19
20
21
22
23
24
25
26
27
28
29
30

CURVED FREE STANDING GARDEN SIEVE

BACKGROUND OF THE INVENTION

The present invention relates to an improved sieve or screen for sifting stones and gravel from garden soil by gravitational means. The new garden sieve may also be used for sifting fine sand from coarse sand and/or gravel or for separating any fine granular product from coarse granular product. Prior art sieves are exemplified by U.S. Pat. Nos. 1,629,149, Citrin; 1,510,742, Gutleben; and 1,424,451 Crandall.

The typical garden sieve consists of a flat rectangular frame, typically made of wood, with a wire screen or mesh affixed to the underside. Its principal use is to remove stones and gravel from garden soil in small quantities. It is utilized by propping it at an angle or setting it on a frame above the ground. The work of sifting stones from garden soil is laborious and time consuming. In known fashion the rectangular frame is placed at an angle to the ground with one end elevated and supported by a vertical brace. The gardener shovels or deposits garden earth aggregate against the screen in order that as the aggregate hits the screen the finer soil material will sift through and the larger stones will roll to the ground in front of the screen. In practice, as the angle of the sieve is increased, the effectiveness of the screen decreases as most of the material will fail to separate. Conversely, as the angle is decreased from the vertical, more fine material will separate on each shovelful, but the coarser material fails to move to the lower end of the sieve and thus impedes separation. Large soil processing equipment designed for processing of far larger quantities than that contemplated herein exists but it is uneconomical, impractical, and unsuitable for typical home garden use.

SUMMARY OF THE INVENTION

The garden sieve of the invention generally comprises a chute-like upper sieve frame member and lower base member. A wire screen disposed at the interface between the two members forms the lower planar portion of the chute. In the preferred embodiment, the upper and lower members are separable to accommodate the wire screens or meshes of different grid sizes so as to vary the size of the particles which may pass through the sieve. The sieve member itself is in the form of a parabolic chute which permits the coarse aggregate to travel, unscreened or unsifted, from top to bottom where it is discharged while the fine soil of the aggregate passes through the screen and is collected for its intended use, for example as topsoil.

For a better appreciation of the invention and its attendant advantages, reference should be made to the following detailed description taken in conjunction with the accompanying drawings.

DETAILED DESCRIPTION OF THE INVENTION

Figures 1, 2, 3:
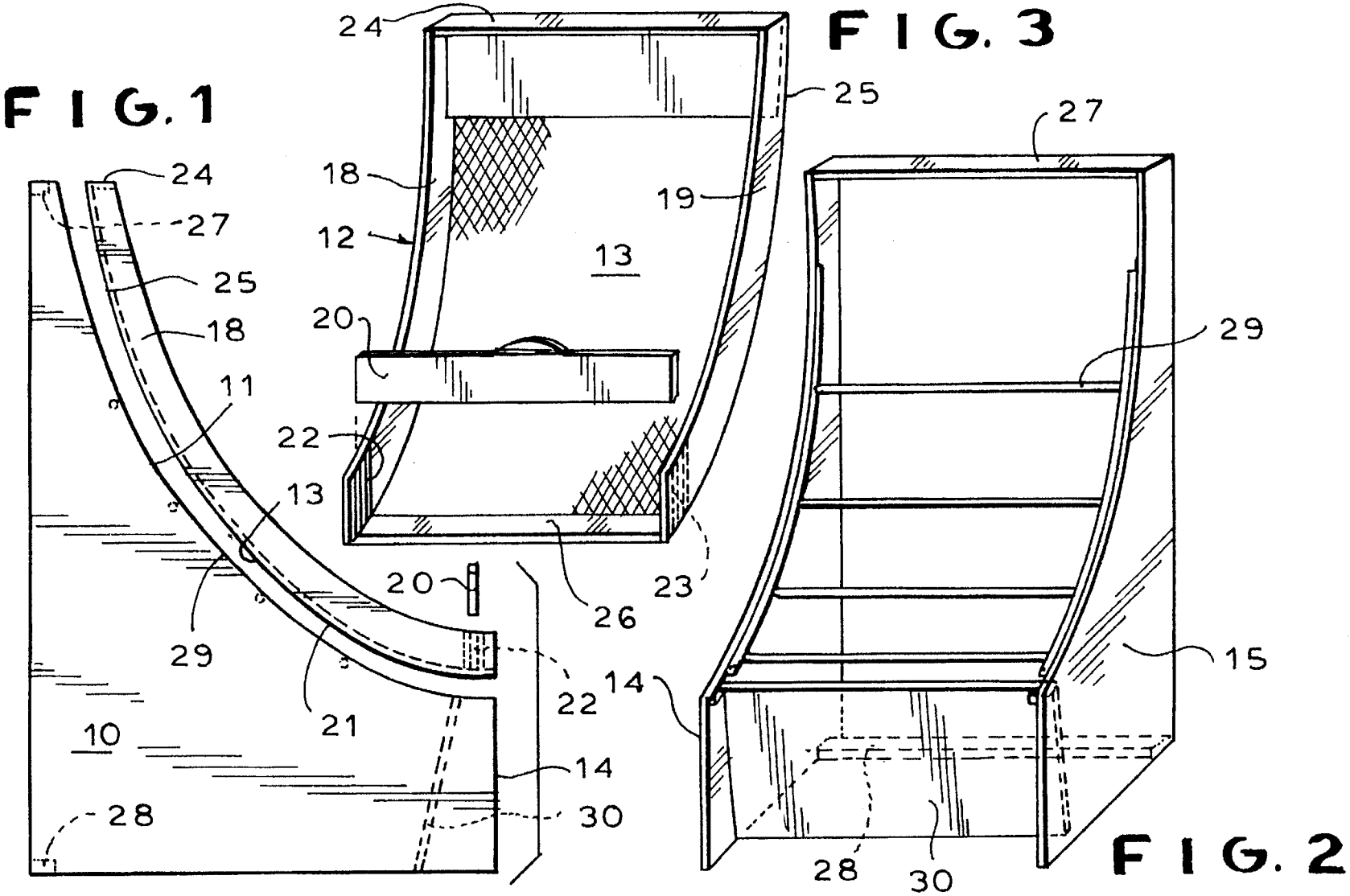
FIG. 1 is an exploded side elevational view of the free standing garden sieve according to the invention showing the upper sieve frame member and the supporting base member.
FIG. 2 is a front perspective view of the base member of the free standing garden sieve unit according to the invention.
FIG. 3 is a front perspective view of the upper sieve member showing the wire screen and a removable drop gate.

The new and improved garden sieve of the present invention comprises a base frame member 10 with a top edge 11 having a predetermined curved surface on which a chute-like sieve frame 12 with a corresponding curved lower surface is mounted. A wire screen or mesh 13 is fastened between the sieve frame (advantageously to the bottom surface 21 of sieve frame side walls 18, 19) and base so that it assumes the curved configuration of the sieve frame 12 and base 10. The two sections 10, 12 are attached together with appropriate hardware and/or mechanical fasteners such as screws, bolts, or the like (not shown). Reinforcing wall panels 24, 25, 26 establish the overall skeletal sieve structure and to add support for the wire screen or mesh. A removable planar, slidable drop gate 20 is disposed at the lower end of the sieve frame and is held in grooves 22, 23 formed The new sieve unit is intended to be used in a fixed position with its upper end perpendicular to the ground and substantially in a vertical plane and with its lower end generally parallel to the ground and substantially in a horizontal plane.

In a preferred embodiment, the base member includes two parallel rigid side panels 14, 15 of plywood or sheet steel joined by a transversely connecting upper and lower braces 27, 28, rod cross-supports 29 in the curved, screen-supporting area, and a front wall 30 to separate the stones or other large, non-sifted or non-screened soil material. The base member 10 is open at its back side to provide access to the pile of topsoil formed by sifting aggregate earth through the screen 13. A wheelbarrow may be disposed in the unit to collect the topsoil.

In use, the gardener will toss shovel loads of garden soil or other material at the highest and nearly vertical section of the chute-like sieve with the result that gravity will accelerate and separate the material as it slides down, through, and along the chute to its lowest level. Stones or other large particles will roll on top of the screen 13 to the bottom section of the frame 12 which is generally horizontal where the removable gate 20 allows such material to be pushed into a receiver by hand or with an appropriate tool such as a shovel. The topsoil formed by sifting through the screen may be removed from the rear of the unit as will be understood.

It is contemplated that the unit will manufactured in various sizes to accommodate one or more individuals working with shovels and with screens of varying mesh sizes depending on the material to be separated. The form of the base member may be varied and made more skeletal, e.g. a simple four-legged support.

Although the foregoing description has been given by way of preferred embodiment, it will be understood by those skilled in the art that other forms of the invention falling within the ambit of the following claims is contemplated. Accordingly, reference should be made to the following claims in determining the full scope of the invention.

I claim:

1. A sieve comprising:

(a) a fixed base with an upper edge having a curved surface with an upper end generally perpendicular to the ground and substantially in a vertical plane and with the lower end generally parallel to the ground substantially in a horizontal plane;

(b) an upper chute-like sieve frame with a lower surface conforming to the shape of the base frame; and (c) a screen supported at the interface of the base and sieve frame.

2. A sieve according to claim 1 wherein (a) a removable vertical gate is disposed at the horizontal end of the sieve frame to facilitate the removal of stones or other large materials.

3. A sieve according to claim 1 wherein (a) the base includes supports reinforcing the unit and engaging the underside of the screen.

* * * * *